US011614245B2

(12) United States Patent
Schofel

(10) Patent No.: US 11,614,245 B2
(45) Date of Patent: Mar. 28, 2023

(54) ROOF VENT

(71) Applicant: Richard A. Schofel, West Long Branch, NJ (US)

(72) Inventor: Richard A. Schofel, West Long Branch, NJ (US)

(73) Assignee: Richard A. Schofel, West Long Branch, NJ (US)

( * ) Notice: Subject to any disclaimer, the term of this patent is extended or adjusted under 35 U.S.C. 154(b) by 331 days.

(21) Appl. No.: 16/935,134

(22) Filed: Jul. 21, 2020

(65) Prior Publication Data

US 2021/0018196 A1 Jan. 21, 2021

Related U.S. Application Data

(60) Provisional application No. 62/876,705, filed on Jul. 21, 2019.

(51) Int. Cl.
*F24F 7/02* (2006.01)
*E04D 13/14* (2006.01)

(52) U.S. Cl.
CPC ..... *F24F 7/02* (2013.01); *E04D 13/14* (2013.01)

(58) Field of Classification Search
CPC ..... F24F 7/02; E04D 13/14; E04D 13/147; E04D 13/1407
See application file for complete search history.

(56) References Cited

U.S. PATENT DOCUMENTS 2,878,743 A 3/1959 Trunnell
3,051,071 A 8/1962 Leigh
3,934,383 A * 1/1976 Perry ..... E04D 13/0352 49/342
5,095,942 A 3/1992 Murphy
5,167,578 A 12/1992 Legault
5,662,522 A 9/1997 Waltz
5,791,985 A 8/1998 Schiedegger et al.
5,934,362 A 8/1999 Barker, II
5,971,847 A 10/1999 Webb
5,984,776 A 11/1999 Berger
6,293,862 B1 9/2001 Jafine et al.
6,767,281 B2 7/2004 McKee
7,004,832 B2 * 2/2006 Thomas ..... B60H 1/00364 454/94
7,022,011 B1 4/2006 Rickman et al.
7,108,600 B1 9/2006 Krzyskowski et al.
(Continued)

FOREIGN PATENT DOCUMENTS

GB 175821 A * 3/1922

OTHER PUBLICATIONS

International Preliminary Report on Patentability Applicaiton No. PCT/2020042938 dated Feb. 3, 2022 consists of 8 pages.
(Continued)

*Primary Examiner* — Jessica Yuen
(74) *Attorney, Agent, or Firm* — Patterson + Sheridan, LLP

(57) ABSTRACT

A roof vent system includes an attic flange member for installing adjacent a roof sheathing inside an attic, a roof skirt coupled to the attic flange and installed on an exterior of a roof, and a roof transition duct having an exterior opening that permits the ingress and egress of air through the roof vent system. The roof transition duct is coupled to the roof skirt and defines an upper end of the roof vent system. A grill is positioned over the exterior opening.

20 Claims, 6 Drawing Sheets

(56) References Cited

U.S. PATENT DOCUMENTS

| | | | |
|---|---|---|---|
| 7,410,416 | B2 | 8/2008 | Fettkether |
| 7,980,266 | B2 | 7/2011 | Niedermair |
| 9,062,454 | B1 | 6/2015 | Borgman et al. |
| 9,341,291 | B2 | 5/2016 | Sandman et al. |
| 9,657,962 | B2 | 5/2017 | Mosley |
| 10,731,891 | B2 | 8/2020 | Khalil |
| 2005/0003755 | A1 | 1/2005 | Koessler |
| 2006/0240762 | A1 | 10/2006 | Railkar et al. |
| 2007/0010191 | A1 | 1/2007 | Vanden Bosch et al. |
| 2010/0124877 | A1 | 5/2010 | Sukup |
| 2011/0312265 | A1 | 12/2011 | Leblanc |
| 2012/0052792 | A1 | 3/2012 | Sinur et al. |
| 2013/0247480 | A1 | 9/2013 | Ridgway |
| 2018/0156482 | A1 | 6/2018 | Khalil |
| 2018/0216845 | A1* | 8/2018 | Whitehead ..... F24F 13/10 |
| 2019/0195520 | A1 | 6/2019 | King, Jr. |

OTHER PUBLICATIONS

International Search REport and Written Opinion Applicaiton No. PCT/2020042938 dated Sep. 30, 2020 consists of 20 pages.

* cited by examiner

ROOF VENT

CROSS-REFERENCE TO RELATED APPLICATION

This application claims priority to U.S. Provisional Patent Application No. 62/876,705, filed Jul. 21, 2019, the disclosure of which is incorporated herein by reference in its entirety.

FIELD

The present invention concerns a roof vent for use on the roof of a house or building for venting moisture from an exhaust fan.

BACKGROUND

A roof vent is typically the termination of the bathroom exhaust fan system and is used to vent air from a bathroom exhaust fan to the exterior. The roof vent is attached to the ductwork that extends from the exhaust fan. The roof vent is useful when a soffit is inaccessible or too far from the bathroom exhaust fan. For example, if the distance of the fan ductwork exceeds the capabilities of the bathroom exhaust fan, the roof vent can be used instead of extending the ductwork to a soffit. Some homes, such as gable homes, do not have soffits. The roof vent of the present invention can be used to vent the exhaust fan so that air and moisture from the fan is not exhausted into the attic. When moisture from a bathroom exhaust is vented into an attic, there is a possibility that mold will develop in the attic space, which can be harmful to health and expensive to remediate, Other uses for the roof vent are also known.

Roof vents can also be used for other purposes, such as for venting toilets, venting attic spaces, and the like, as known by those of skill in the art.

Many Roof vents presently on the market require nails to be used to secure the roof vent to a roof. Nails that extend through the sheathing of a roof can be detrimental to the integrity of the roof.

DESCRIPTION

Figure 1:
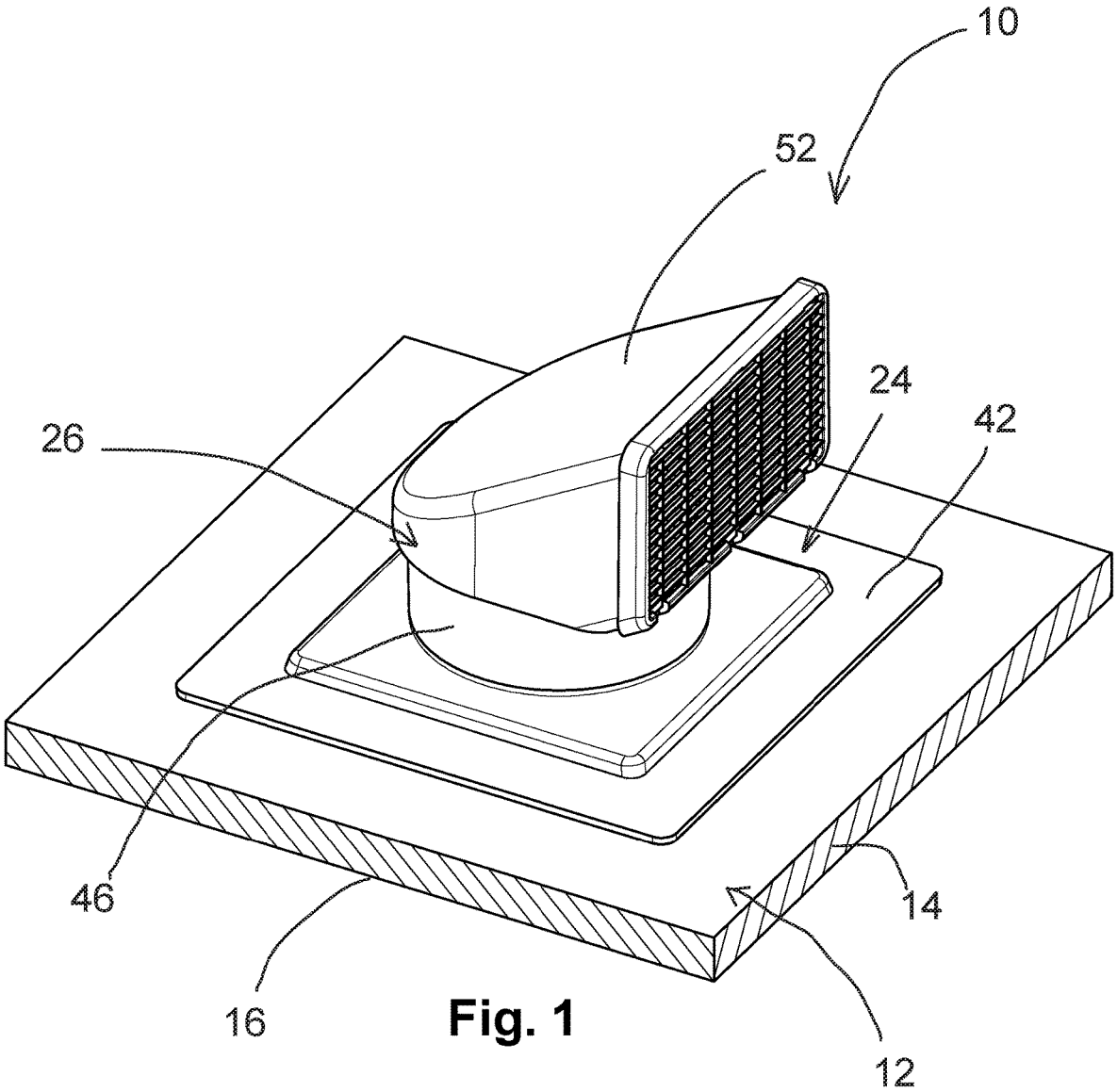
FIG. 1 depicts a perspective view of a roof vent positioned at an angle, installed on an angled roof.
Figure 2:
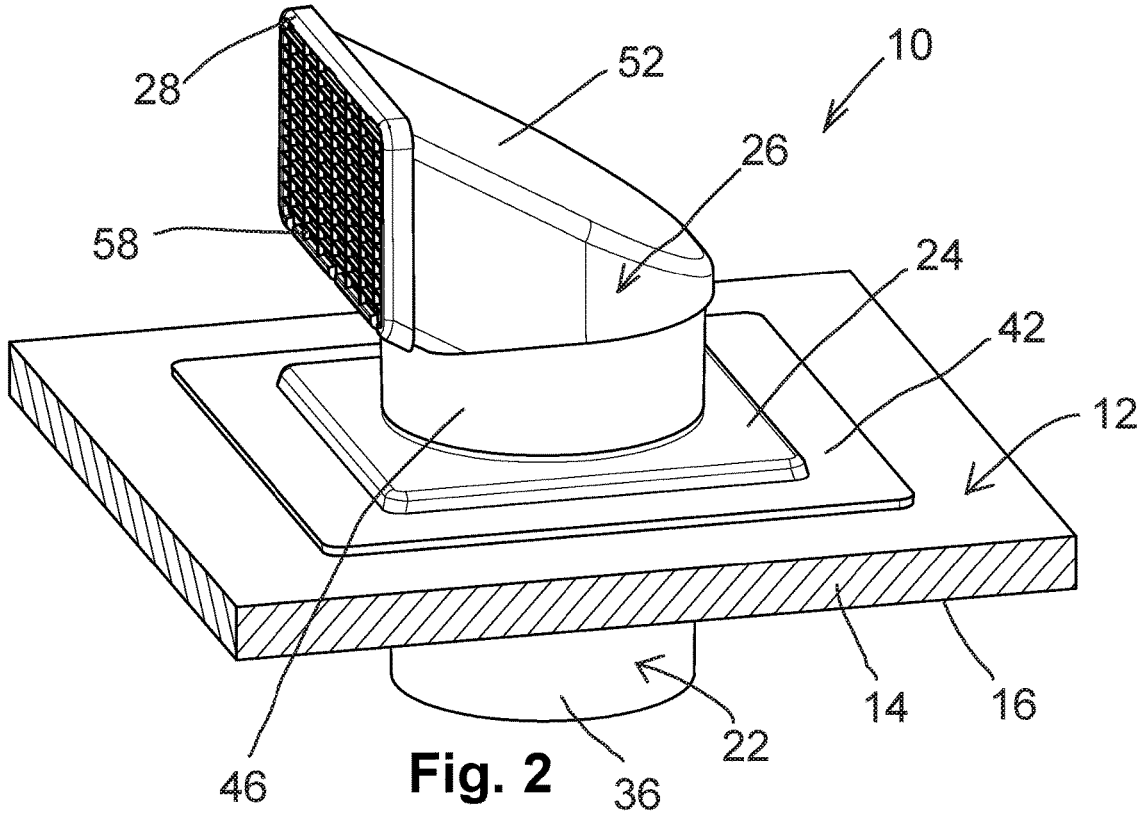
FIG. 2 depicts a perspective side view of a right side of the roof vent in an assembled configuration.
Figure 3:
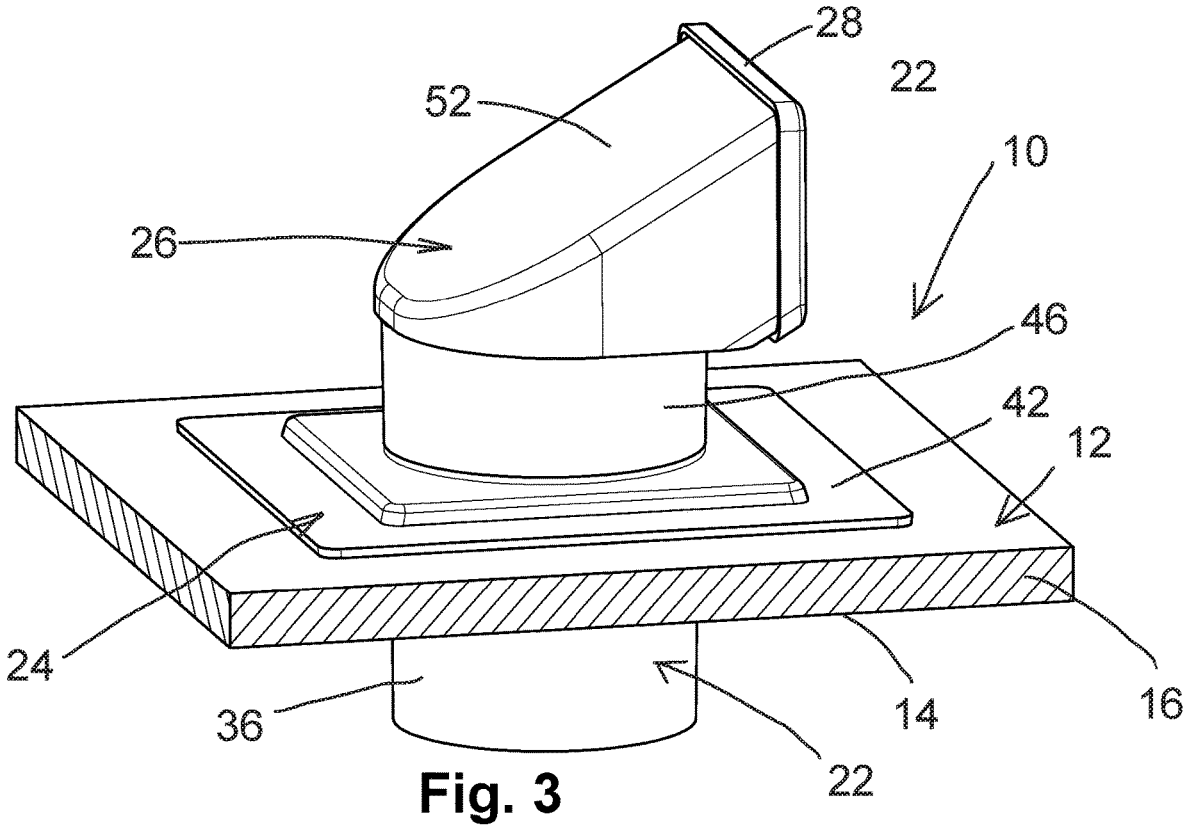
FIG. 3 depicts a perspective side view of a left side of the roof vent as shown in FIG. 2.
Figure 4:
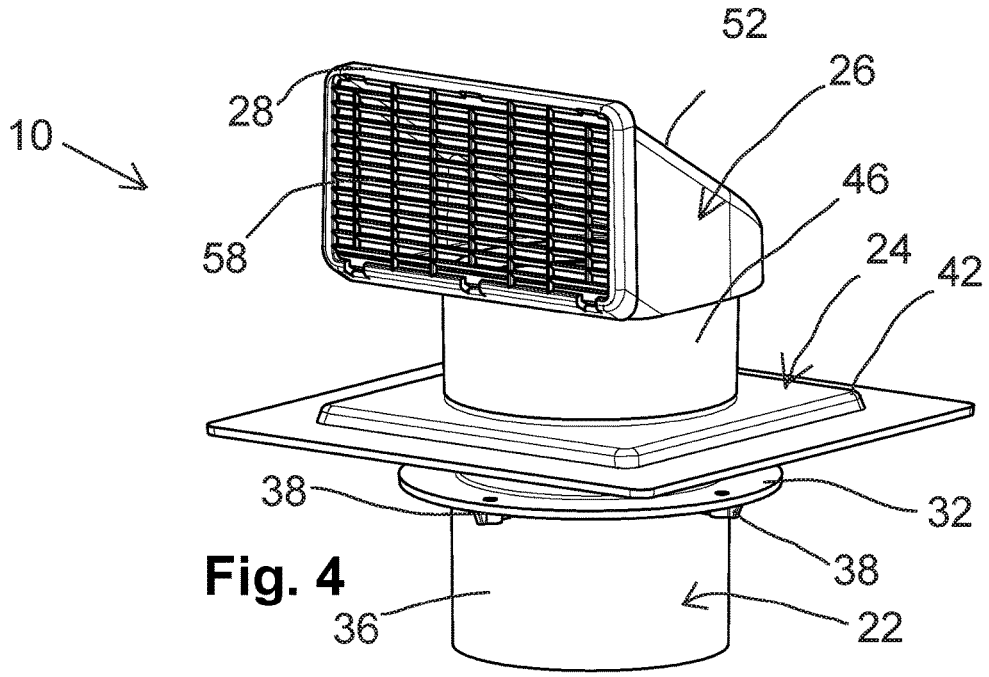
FIG. 4 depicts a front perspective view of the roof vent of FIG. 1 showing the open end of the roof vent.

A roof vent 10 can serve as a termination of the bathroom exhaust fan system. Many existing roof vent designs project moist air from the bathroom exhaust fan directly onto the roof shingles. The example roof vent 10 described herein directs the air upwardly, away from the roof surface 12, which is better for the roof shingles.

Presently known roof vents include a flange and nails are inserted through the flange to penetrate the roof sheathing 14. The roof vent 10 described herein does not require the use of nails that penetrate through the roof sheathing 14. Instead, the roof vent 10 is attached to the underside 16 of the sheathing 14 with screws 18 that do not penetrate the sheathing 14. The screws 18 may be sized based upon the thickness of the sheathing 14. Alternatively, an additional piece of wood (not shown) may be installed to increase the thickness of the sheathing such that the screws 18 that secure the roof vent 10 to the roof do not penetrate the roof sheathing 14.

In one example, if the sheathing is ½ in. thick, a piece of wood, plywood, or other material may be attached to the underside 18 of the roof sheathing 14 with wood glue or construction adhesive. Then a hole 20 is cut through the sheathing 14/roof so that the roof vent 10 can extend through the sheathing 14. A sealant (not shown) may then be applied between the roof vent 14 and the opening 20 in the sheathing 14. Silicone or other sealants may be used. It is preferred that the sealant be resistant to breaking down when exposed to the exterior elements. The roof vent 10 of the present invention is not watertight.

The roof vent 10 is advantageous in that it can be installed in close proximity to a bathroom exhaust fan without requiring extensive duct work. The roof vent 10 can also be placed at other locations on the roof by using duct work that extends from the exhaust fan to the lower end of the roof vent 10. The roof vent 10 can be placed at any desired location on any type of roof, including slanted and flat roofs and does not have to be connected to ductwork, if desired.

The roof vent 10, as shown in the figures, includes an attic flange member 22, a roof skirt 24, a roof transition duct 26, a removable grill 28, and a flap 30. The attic flange member 22 includes a substantially centrally located flange extension 32, an upper duct member 34 and a lower duct member 36, with the flange extension being positioned between the upper and lower duct members 34, 36. The flange extension 32 extends perpendicular to the surface of the attic flange member 22 and is perpendicular to a longitudinal axis of the attic flange member 22. The flange extension 32 includes screw holes 38 for receiving screws. When installed on a roof the flange extension 32 abuts a lower side 16 of the roof sheathing 14.

The roof skirt 24 includes a central duct 40 that extends upwardly from a perpendicular portion 42 that serves as a skirt to cover a part of the roof. The perpendicular portion 42 of the roof skirt has a substantially flat lower surface 44 to abut a roof. The roof skirt 24 perpendicular portion 42 seats on a roof and that covers the opening 20 in the roof created by the extension of the attic flange member 22 that extends through the opening 20 in the roof. The upwardly extending duct 40 of the roof skirt 24 seats around the upper duct member 34 of the attic flange member 22. The fit between the duct 40 and the upper duct member 34 may be a tight fit, such as a press fit, to deter the egress of moisture between the parts of the roof vent 10.

A roof transition duct 26 is an upper part of the roof vent that is positioned above the roof skirt 24 and the attic flange member 22. The roof transition duct 26 includes a lower duct 46 that is sized to seat over the upper end 48 of the roof skirt central duct 40. The lower duct 46 is coupled to an upper end of the roof vent 10 and includes an opening for receiving the removable grill 28. The flap 30 is positioned at the upper end 48 of the roof skirt central duct 40.

The roof vent 20 is installed on a roof and the attic flange member 22 of the system seats parallel to the slope of the roof. This is shown in the figures where the roof skirt 24 seats directly on the sloped surface of the roof. The roof vent transition duct 26 has a longitudinal axis that is perpendicular to the pitch of the roof so that moist air is not directed onto the roofing shingles.

Figure 5:
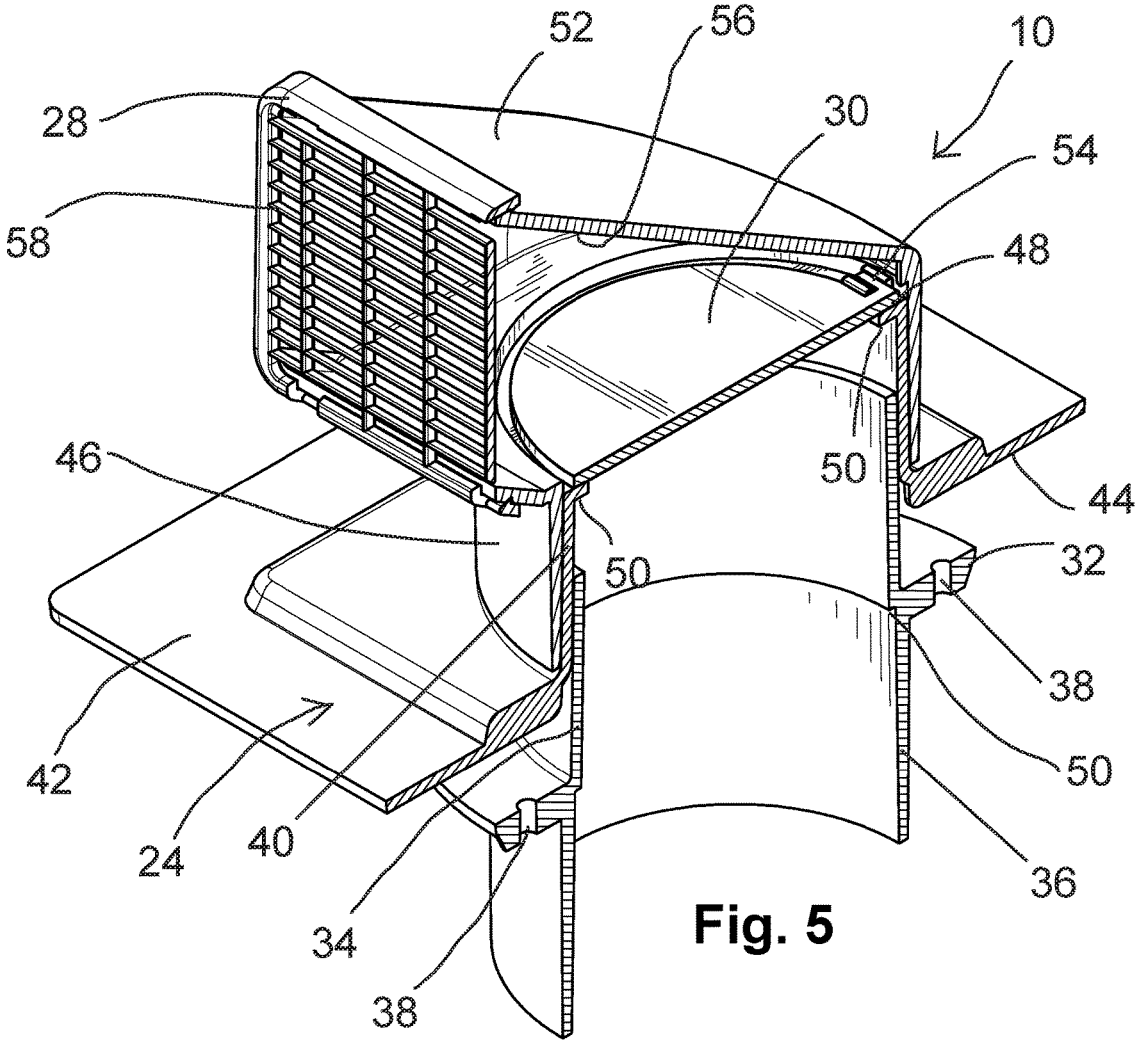
FIG. 5 depicts a cross-sectional perspective view of the roof vent shown in FIG. 4.
Figure 6:
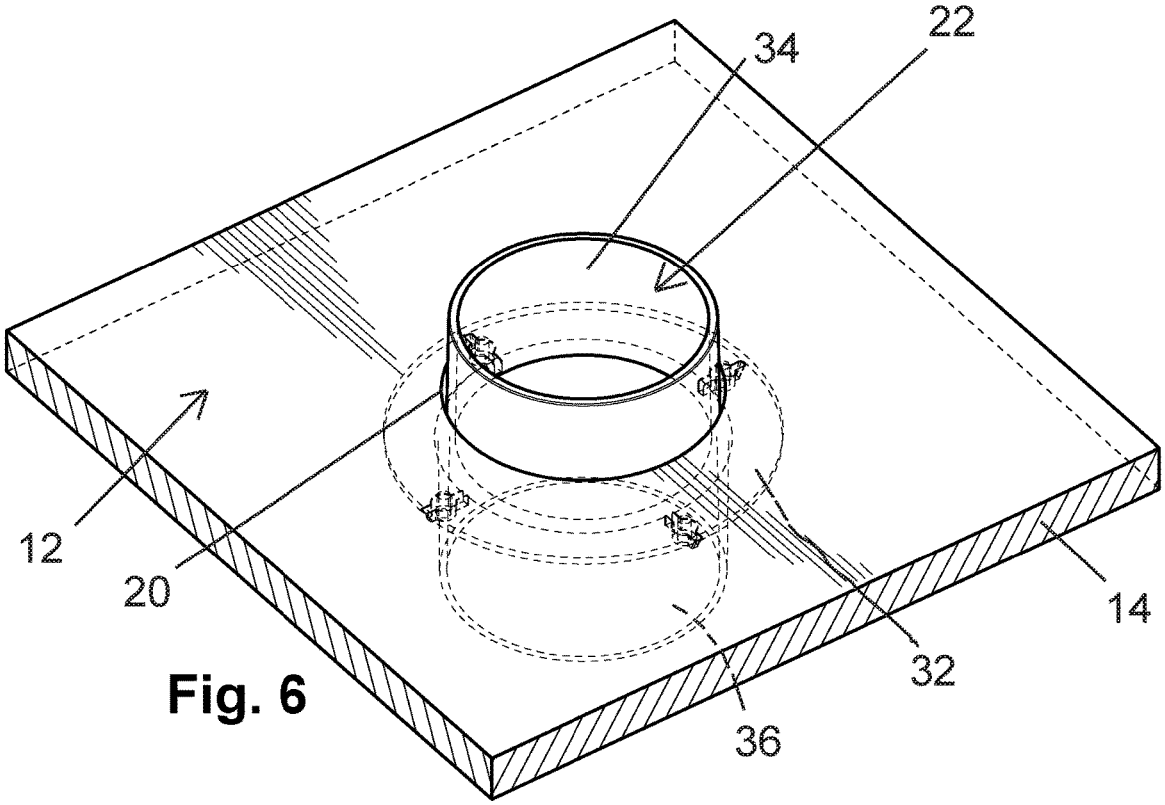
FIG. 6 depicts a top view of the attic flange member, which includes a duct coupled to an attic flange extending through the roof, as viewed from above the roof.
Figure 7:
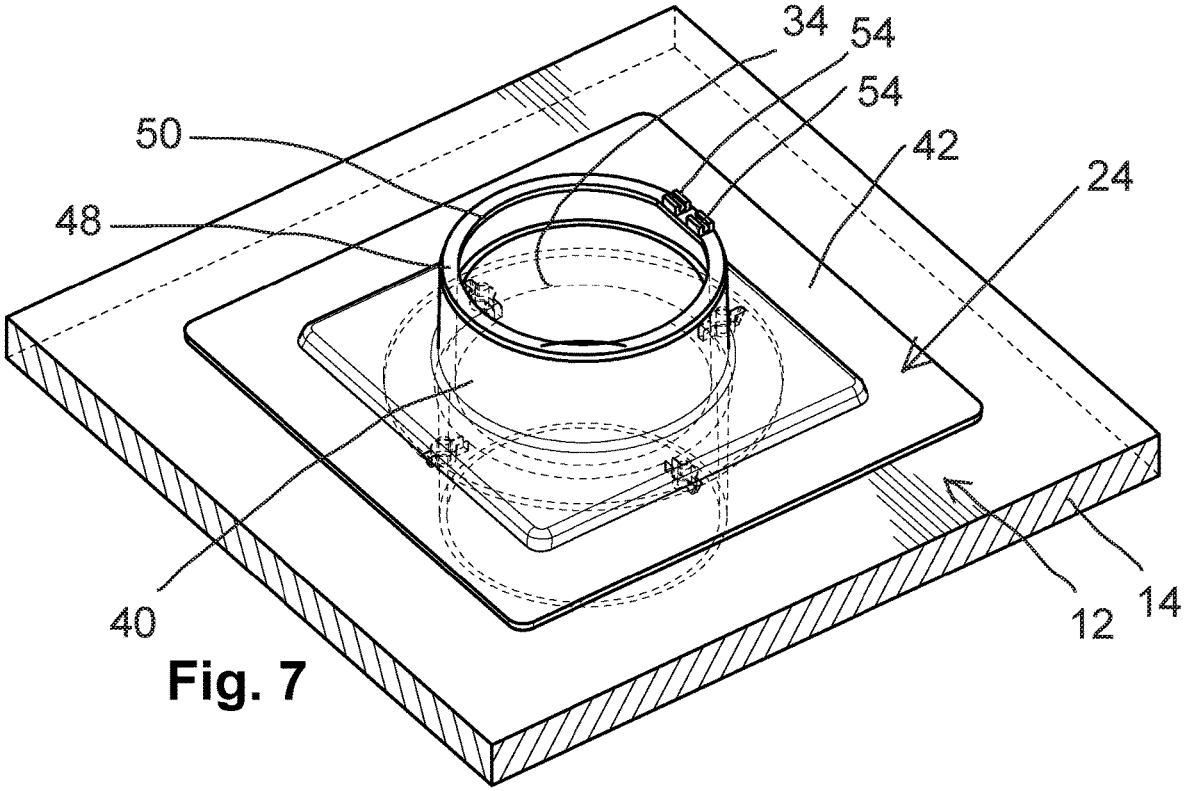
FIG. 7 depicts a top view of a roof skirt installed over the duct shown in FIG. 6.
Figure 8:
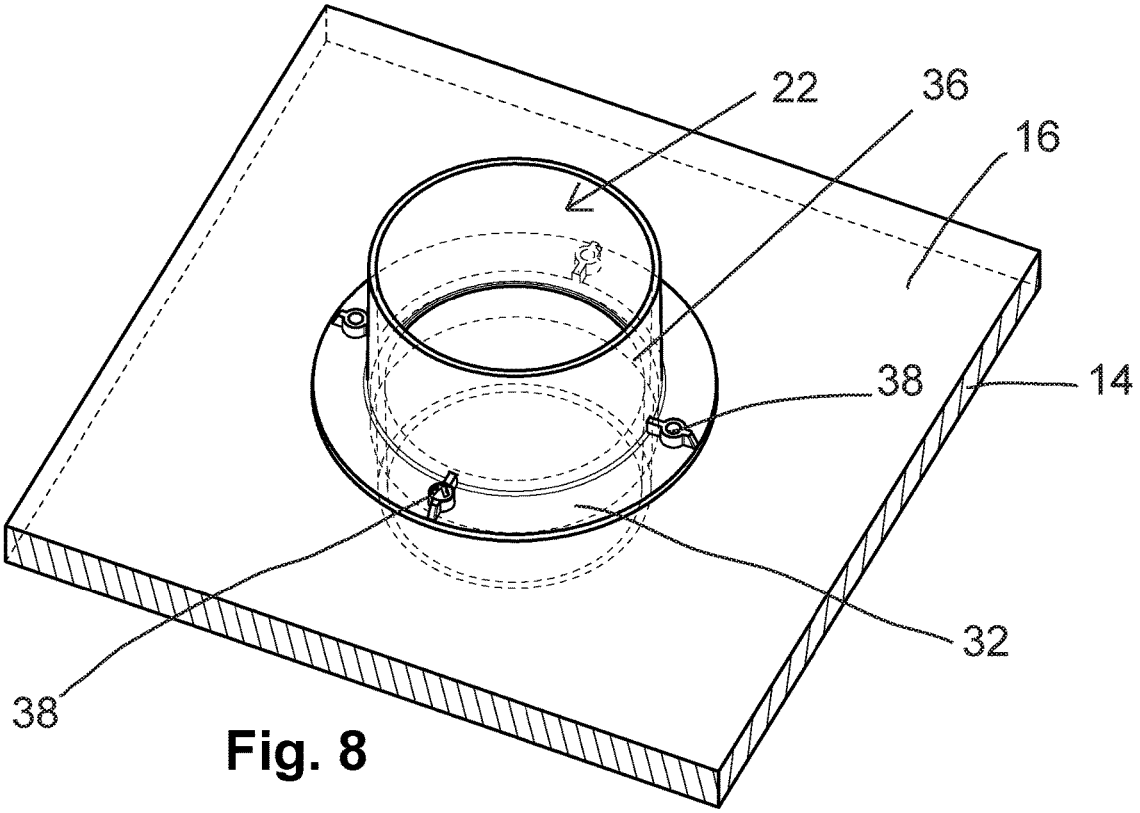
FIG. 8 depicts a bottom view of an attic flange member that includes a bottom duct, with the attic flange member being installed on a lower side of roof sheathing and the attic flange being screwed to the roof sheathing such that the bottom duct extends downwardly from the attic flange.
Figure 9:
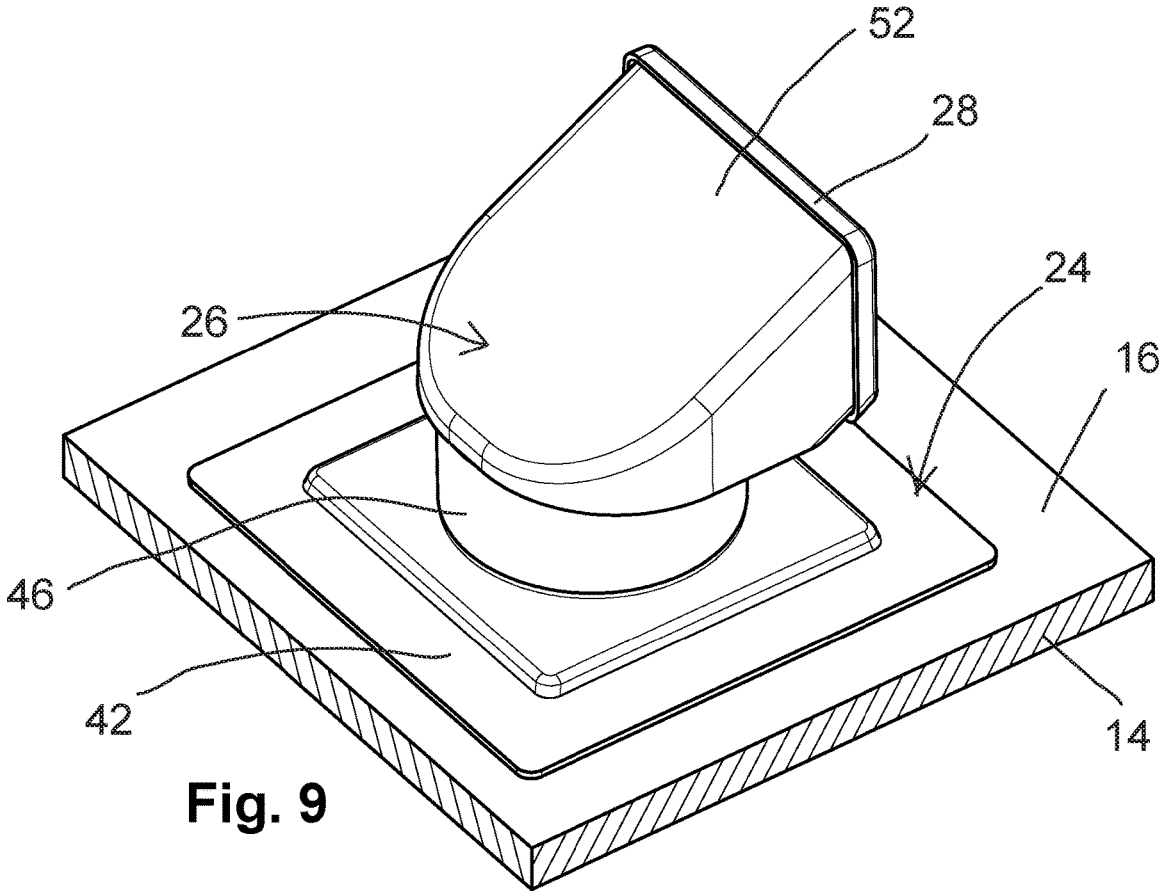
FIG. 9 depicts a top view of a roof vent installed on top of the roof sheathing.
Figure 10:
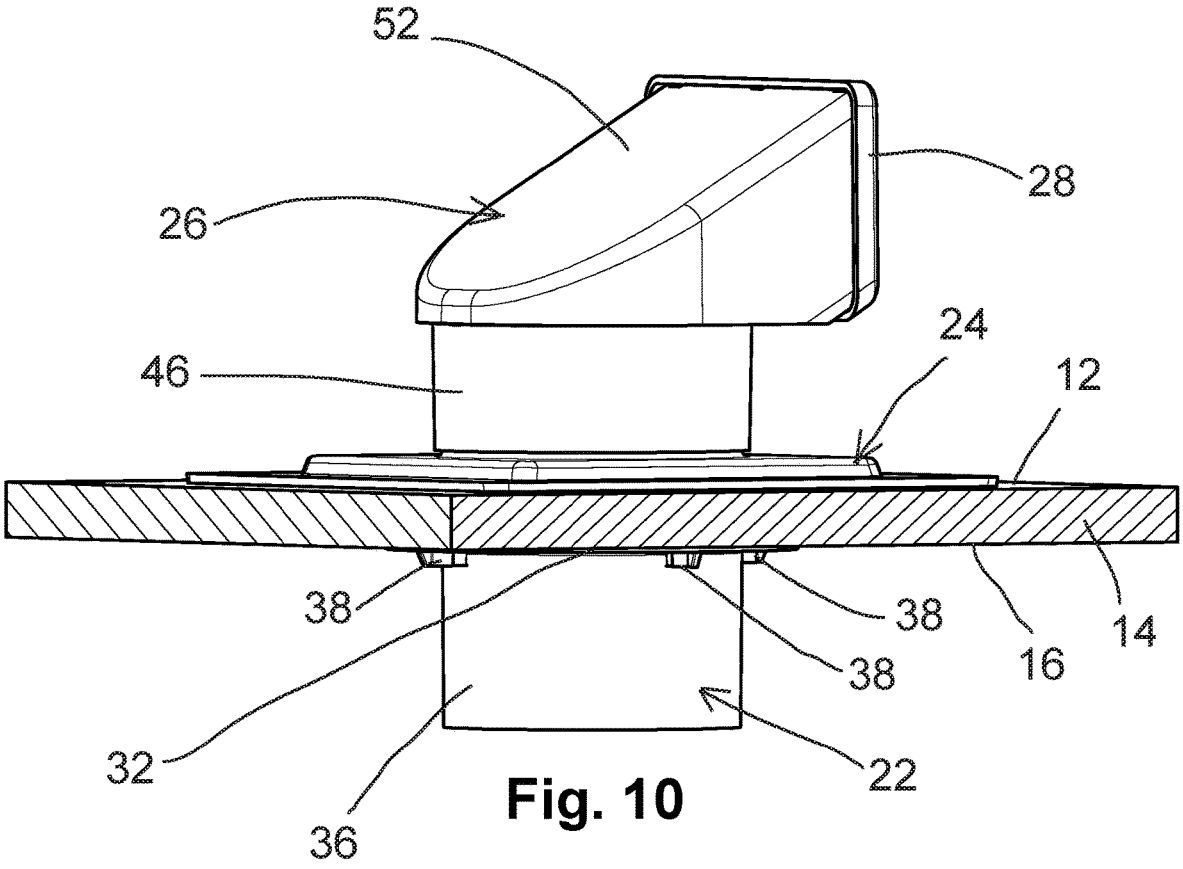
FIG. 10 depicts a side view of a roof vent installed on the roof sheathing showing the upper and lower portion of the roof vent.

The parts of the roof vent system may be compression fit together when installed. Each piece is inserted into the other until they abut a stop lip 50, if present, so that water/moisture may not enter the interior connections. A stop lip 50 is shown in FIG. 5 as positioned at the intersection of the slanted upper surface 52 of the roof transition duct 26 and the lower duct 46 of the roof transition duct 26. Stop lips 50 could also be positioned inside the wall of the roof skirt central duct 40. Another stop lip 50 is provided by the upper end of the roof skirt central duct 40, as shown in FIG. 5. Whether the stop lip 50 is contacted will depend upon the thickness of the roof.

A silicone sealant may be used to seal the various parts together when using a compression fit or if not using a compression fit. Silicone or other sealants may be applied at any seam between the various parts. Silicone or another sealant may also be applied around the base of the roof transition duct 26 that sits on the roof skirt 24. The silicone is preferably an exterior silicone that is flexible.

In one example, the attic flange member 22 is 8"×8" and seats on the felt paper/synthetic roofing underlay (not shown). The attic flange member 22 covers the opening 20 that is cut out by the user or that was cut out from prior roof vent installations. To prevent stack effect with the roof vent, ductwork from the exhaust fan may be insulated.

Because of the design, water may not migrate up to the top of the tube of the compression fittings of the attic flange member 22 and the roof skirt 24. The air flap 30 is used to prevent wind from blowing back down the duct. The roof vent 10 parts are telescopically coupled together. This permits for variability in terms of the roof thickness and the distance from the exhaust fan. Additional duct work may be used, if needed to couple the roof vent 10 to the exhaust fan discharge.

The flap 30 is coupled to the upper end of the roof skirt central duct 40 by a hinge 54. For example, a plastic snap hinge 54 may be used, as shown, or other hinge shapes and designs could be used. The flap 30 opens when air flow from the exhaust fan is present in the duct work, which creates pressure sufficient to rotate the flap 30 upwardly around the hinge 54 into an open position. An upper end of rotation of the flap 30 occurs when the flap 30 encounters an interior surface 56 of the upper surface 52 of the roof transition duct 26. The rotation of the flap 30 can be limited by the shape of the upper surface 52 of the roof transition duct 26. If desired, a stop (not shown) can extend downwardly from the interior surface 56 of the upper surface 52 of the roof transition duct 26. The flap 30 rotates upwardly when it encounters air from the exhaust fan and falls downwardly to close when air from the exhaust vent stops pumping air through the duct. When in the closed position, the flap abuts the stop lip 50 positioned at the upper end of the roof skirt central duct 40. If a stop is positioned on the interior surface 56, the stop can be angled or otherwise shaped.

When in the closed position, the flap abuts the upper end of the central duct 40 of the roof skirt 24. The flap 30 is controlled by gravity and has a shape and size that permits it to open upon interaction with sufficient air/pressure from the exhaust fan but falls downwardly when the exhaust fan is turned off. Closing of the flap 30 deters insects or rain and snow from entering the interior of the unit 10.

If desired, the flap 30 could be biased into a closed position. The hinge 54 and flap 30 could be located at different locations, if desired. The flap 30 is substantially circular in shape, but could have other shapes, if desired, as long as the flap serves to close off the opening in the duct 40.

The flap 30 of the roof vent 10 opens to the exterior, allowing moist air to be extracted to the exterior. When the exhaust fan is not in use, the flap 30 closes and prevents wind, rain, or snow from traveling down through the duct. The flap 30 opens in one direction.

In the case of other types of vents, e.g., those not associated with an exhaust fan, the flap 30 may be excluded if it is not needed. Other vents are used, for example, for regulating pressure in plumbing pipes to ensure that water flows unimpeded through the plumbing. Vent pipes are typically dry, meaning that no water is permitted to back up into them under normal operation. The air vent is a pipe that is connected to the waste line of the plumbing elements and that empties into the waste line that goes into the sewer. All vents are typically connected to one another through branch lines into a main stack, that vents the main toilet(s). The main stack typically extends through the roof, although some plumbing codes permit the main stack to extend through a wall instead. With a toilet vent, if water from the exterior enters the upper end of the toilet vent, water will flow into the sewer and will not be detrimental to the operation of the toilet vent, making a flap unnecessary.

Sealing of the roof vent is advantageous to deter water from entering an attic. To seal the roof vent against the roof sheathing, caulk may be installed around the sheathing and the protrusion of the attic flange (flange extension) 32 tube that inserts into the roof skirt 24. Because of the location inside the attic, the caulking is not exposed to the sun or weather, making it last longer.

The grill 28 of the roof vent 10 system is removable for cleaning purposes. For example, if debris were to cover and/or block part of the grill 28, the grill 28 can be removed, cleaned, and reinstalled. The grill 28 includes vanes 58 that direct air upwardly at an angle, away from the surface of the roof 12. One angle that may be used is 45 degrees. The angle of the vanes 58 of the grill 28 may vary depending upon the angle of the roof. However, an angle such as 45 degrees or more will likely result in directing air away from the surface of the roof 12.

The roof vent 10 may be used as original equipment or can be used as a retrofit for an existing roof vent. When installing the roof vent 10 as a retro fit, adhesive used to attach the pre-existing roof vent is separated to remove the old roof vent. The existing shingles around the replaced vent are reattached with caulking where the adhesive was separated during removal of the roof vent.

Advantageously, the roof vent 10 can be removed and reused again should there be a need to replace the roofs shingles or the roof sheathing 14. Because the parts of the roof vent 10 system are compression fit together, they can be pulled apart and reinstalled together following the original steps for installation. In contrast, when traditional roof vents that have nails for fixation through the flanges are removed from a roof, they have a tendency to bend out of shape and often need to be replaced.

The roof vent 10 is designed to be the terminating end of the exhaust fan venting system. The roof vent 10 is connected to the extension tube (not shown) of the exhaust fan. The roof vent 10 is designed for a roof deck installation.

The roof vent 10 may be manufactured with a green product that is eco-friendly. One type of product is known as THRIVE™, which is a sustainable thermoplastic composite that is reinforced with cellulose fibers. It is UV stabilized for both hot and cold temperatures, making it preferable for a roof location due to common fluctuations in temperature. Other types of materials may also be used, including other plastics or thermoplastics, among other materials.

The roof vent 10 is easy to install and readily accessible inside the attic. The presently designed roof vent 10 can be used on roof pitches from 3/12 to 12/12. Other types of roofs may also derive a benefit from the roof vent 10 with some modifications to accommodate the pitch of the roof. The roof vent 10 is compatible with all exhaust fan ductwork. The roof vent 10 also reduces friction losses associated with air flow of the exhaust fan.

The fixation attachments 38 of the roof vent 10 are not exposed on the surface of the roof, which assists in preventing leaks around the roof at the roof vent 10. The roof vent 10 is compatible with all roofing materials.

A roof vent system includes an attic flange member, a roof skirt, a roof transition duct, and a grill. The attic flange member is for installing adjacent a roof sheathing inside an attic. The roof skirt is coupled to the attic flange member and installed on an exterior of a roof. The roof transition duct has an exterior opening that permits the ingress and egress of air through the roof vent system. The roof transition duct is coupled to the roof skirt and defines an upper end of the roof vent system. The grill is positioned over the exterior opening.

The roof vent system may also include a flap positioned inside the roof vent. The flap may seat on the roof skirt and may be coupled to the roof skirt via a hinge.

The attic flange member may include a lower duct member, an upper duct member, and a flange extension positioned between the lower duct member and the upper duct member. The upper duct member and the lower duct member may be longitudinally aligned. The flange extension extends outwardly from the attic flange member for permitting coupling of the attic flange member to a roof. The flange extension may include screw holes for receiving screws that couple the attic flange member to a roof.

The roof skirt may include a central duct having a longitudinal axis and a skirt that extends perpendicular to the longitudinal axis of the central duct. The skirt may have a substantially flat lower surface for abutting an exterior surface of a roof.

The roof transition duct includes a lower duct having a longitudinal axis, an upper portion, and an opening coupled to the upper portion. The upper portion is the upper most part of the roof vent system. The opening in the roof transition duct is positioned at an angle relative to the longitudinal axis of the lower duct to permit air to exit the opening upwardly.

A grill cover may be positioned over the opening, with the grill cover including a plurality of vanes. The grill cover may be removable and replaceable. The plurality of vanes may be angled upwardly. The plurality of vanes may be angled upwardly at a 45-degree angle.

The upper portion of the roof transition duct may include a slanted surface that extends between the lower duct and the opening. The opening may be positioned above an upper end of the lower duct.

The roof vent system may also include a flap that is positioned inside the roof vent. The flap may be positioned at the upper end of the roof skirt below the upper portion of the roof transition duct. The flap may be positioned at the upper end of the roof skirt below the upper portion. The flap may be rotatable upwardly around a hinge. The slanted surface of the upper portion may serve as a stop for the rotation of the flap.

The attic flange member, the roof skirt, and the roof transition duct are fitted together via a compression fit. The upper part of the attic flange has a first outer diameter. The roof skirt central duct 40 has a second inner diameter and a third outer diameter. The roof transition duct lower duct 46 has a fourth inner diameter. The first outer diameter is substantially the same as or smaller than the second inner diameter. The third outer diameter is smaller than or substantially equal to the fourth inner diameter. A stop may be positioned at the upper end of the roof skirt central duct.

The roof vent system may also include a sealant for use in sealing between the various parts of the roof vent system.

The roof transition duct may have a lower duct that defines a longitudinal axis and the opening of the roof transition duct may be angled at a perpendicular angle of about 90 degrees or more relative to the longitudinal axis.

The term "substantially," if used herein, is a term of estimation.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. A roof vent system comprising:

an attic flange member for installing adjacent a roof sheathing inside an attic, the attic flange member having a flange extension that includes screw holes for receiving screws for securing the attic flange member to the roof sheathing from inside the attic, the attic flange member having an upper duct member extending a first direction from the flange extension and a lower duct member extending a second direction from the flange extension, the first direction opposite of the second direction;

a roof skirt configured to telescopically couple with the attic flange member and configured to be installed on an exterior of a roof, the roof skirt having a central duct and a skirt portion, the skirt portion circumscribing and extending outward from the central duct, the skirt portion configured to be installed against the exterior of the roof, the skirt portion devoid of holes for coupling the roof skirt to the roof, the upper duct member configured to extend into the central duct through the skirt portion;

a roof transition duct having an exterior opening that permits the ingress and egress of air through the roof vent system, the roof transition duct coupled to the roof skirt and defining an upper end of the roof vent system, the roof transition duct having a lower duct having an inside diameter the same as or slightly larger than an outside diameter of the central duct; and a grill positioned over the exterior opening.

2. The roof vent system of claim 1, further comprising a flap positioned inside the roof vent.

3. The roof vent system of claim 2, wherein the flap seats on the roof skirt and is coupled to the roof skirt via a hinge.

4. The roof vent system of claim 1, wherein the skirt portion extends perpendicular to a longitudinal axis of the central duct.

5. The roof vent system of claim 1, wherein the opening is positioned at an angle relative to the longitudinal axis of the lower duct to permit air to exit the opening upwardly.

6. The roof vent system of claim 1, the grill includes a plurality of vanes.

7. The roof vent system of claim 6, wherein the plurality of vanes are angled upwardly.

8. The roof vent system of claim 7, wherein the plurality of vanes are angled upwardly at a 45-degree angle.

9. The roof vent system of claim 1, wherein the grill is removable and replaceable.

10. The roof vent system of claim 1, wherein the upper portion includes a slanted surface that extends between the lower duct and the opening, with the opening being positioned above an upper end of the lower duct.

11. The roof vent system of claim 1, further comprising a flap positioned inside the roof vent, wherein the flap is positioned at the upper end of the roof skirt below the upper portion of the roof transition duct.

12. The roof vent system of claim 11, wherein the flap is positioned at the upper end of the roof skirt below the upper portion and is rotatable upwardly around a hinge, and the slanted surface of the upper portion serves as a stop for the rotation of the flap.

13. The roof vent system of claim 1, wherein the attic flange member, the roof skirt, and the roof transition duct are fitted together via a compression fit.

14. The roof vent system of claim 1, wherein lower duct defines a longitudinal axis and the opening of the roof transition duct is angled at a perpendicular angle of about 90 degrees or more relative to the longitudinal axis.

15. The roof vent system of claim 1, wherein the roof transition duct is compression fit to the roof skirt.

16. The roof vent system of claim 1, wherein the central duct is radially sandwiched between an outside diameter of the upper duct member and the inside diameter of the lower duct.

17. The roof vent system of claim 16, wherein the central duct is compression fit with the upper duct member and the lower duct.

18. A roof vent system comprising:

an attic flange member for installing adjacent a roof sheathing inside an attic, the attic flange member having an upper duct member separated from a lower duct member by a flange extension, wherein the flange extension includes screw holes for receiving screws for securing the attic flange member to the roof sheathing from inside the attic;

a roof skirt configured to telescopically couple over the attic flange member and configured to be installed on an exterior of a roof, the roof skirt having a a central duct and a skirt portion, the skirt portion circumscribing and extending outward from the central duct, the skirt portion configured to be installed against the exterior of the roof, the skirt portion devoid of holes for coupling the roof skirt to the roof, the upper duct member configured to extend into the central duct through the skirt portion;

a roof transition duct configured to telescopically couple over the roof skirt, the roof transition duct having an exterior opening that permits the ingress and egress of air through the roof vent system, with the roof transition duct coupled to the roof skirt and defining an upper end of the roof vent system;

a grill positioned over the exterior opening, the grill having a plurality of upwardly angled vanes; and a flap positioned inside the roof vent, wherein the flap seats on the roof skirt and is coupled to the roof skirt via a hinge.

19. The roof vent system of claim 18, wherein the central duct is radially sandwiched between an outside diameter of the upper duct member and an inside diameter of the lower duct.

20. The roof vent system of claim 19, wherein the central duct is compression fit with the upper duct member and the lower duct.

* * * * *